US005279264A

United States Patent [19]

Simmons et al.

[11] Patent Number: 5,279,264

[45] Date of Patent: Jan. 18, 1994

[54] VIEWABLE THERMOSTAT DEVICE

[75] Inventors: Johnny C. Simmons; Robert P. Fowler, both of Odessa, Tex.

[73] Assignee: In-Line Products Incorporated, Odessa, Tex.

[21] Appl. No.: 67,131

[22] Filed: May 26, 1993

[51] Int. Cl.[5] ..... F01P 7/14

[52] U.S. Cl. ..... 123/41.1; 236/34; 251/368

[58] Field of Search ..... 123/41.1, 41.8; 236/34, 236/34.5; 251/368

[56] References Cited

U.S. PATENT DOCUMENTS

| | | | |
|---|---|---|---|
| 1,806,072 | 5/1931 | Levy | 123/41.1 |
| 2,062,937 | 12/1936 | Root | 236/34 |
| 2,765,983 | 10/1956 | Mayo | 236/34 |
| 3,601,181 | 8/1971 | Avrea | 123/41.21 |
| 4,413,675 | 11/1983 | Gano | 123/41.15 |
| 4,583,499 | 4/1986 | Hovey | 123/41.1 |

*Primary Examiner*—Noah P. Kamen

*Attorney, Agent, or Firm*—Breneman & Georges

[57] ABSTRACT

A viewable thermostat device for providing visual confirmation of the proper operation of a thermostat in operating engines having a fluid coolant is provided by the utilization of a transparent thermoplastic housing having means for capturing the annular flange of the thermostat and maintaining the thermostat perpendicular to the direction of flow of the coolant while allowing a visual confirmation of the proper operation of the thermostat. The transparent thermoplastic housing is preferably formed from a transparent polyurethane or polycarbonate plastic and may include curved surfaces for optically enhancing the visual inspection of the operation of the thermostat as well as covers or sleeves for protecting the clear plastic from exterior abrasion or dirt. The viewable thermostat device is applicable to in-line installation as well as installations directly connected to the engine block to provide visual confirmation of the proper operation of the thermostat during engine operation.

20 Claims, 5 Drawing Sheets

VIEWABLE THERMOSTAT DEVICE

BACKGROUND OF THE INVENTION

1. Field Of The Invention

The invention pertains to a transparent thermoplastic thermostat housing for providing a visual indication of the precise operation of the engine thermostat in all phases of engine operation. More particularly the invention pertains to a transparent thermoplastic housing which may include optically enhanced surfaces for magnifying the visual display of the thermostat within the transparent housing to provide direct visual confirmation of the operation of the thermostat by providing direct visual access to the thermostat through the engine coolant or by imparting a churning action to the coolant where the coolant is highly colored or opaque.

The transparent thermoplastic housing may be disposed between sections of radiator hose or may include provision for direct mounting to the engine block. In all such applications the transparent thermoplastic housing includes means for engaging the annular flange of the thermostat and maintaining the thermostat in a proper orientation to the direction of flow of engine coolant. The transparent housing for the engine thermostat may be constructed in a variety of configurations for capturing the engine thermostat and may be of one or more piece construction. The housing assists in maintaining the thermostat in place and providing visual access to the thermostat and providing disrupted flow of the coolant to confirm the proper operation of the thermostat.

The transparent thermostat housing may be placed in line that is between sections of radiator hosing or be placed against the engine block to provide the advantages of visual confirmation as to the status and operation of the thermostat as well as the condition of the engine coolant under all engine operating conditions. The transparent thermoplastic housing may be constructed of thermoplastic materials such as transparent polyurethanes and polycarbonates and other transparent plastics which are thermally stable and translucent. The transparent thermoplastic housing may be covered by an optional protective sleeve made of canvas, fabric, fiberglass, rubber, plastic or the like to protect the outside surface of the viewable thermostat from oil, grease, dust and debris so the flowing motion of the engine coolant as well as the operation of the thermostat can be visually detected without requiring cleaning particularly where such operation is in dusty or greasy environments.

2. Description Of The Prior Art

The prior art includes a wide variety of thermostat housings for use in controlling the temperature of internal combustion engines. The thermostat housing is generally contained between the engine block and a metal pipe having a flange which is bolted to the engine block. The metal pipe is then connected to the radiator inflow hose to transport hot engine coolant to the radiator. An example of such a prior art setup is shown in Schroeder U.S. Pat. No. 4,327,673.

More recently applications have been introduced for in-line thermostats which include a thermostat housing which is connected between sections of the radiator in-flow hose such as illustrated in Hovey U.S. Pat. No. 4,583,499. In other prior art such as Reynolds U.S. Pat. No. 4,993,628 and 5,123,591 special radiator out-flow hoses have been constructed to engage the thermostat in a position in the radiator hose. This prior art has the advantage of providing improved access to the thermostat for maintenance but does not provide visual access for determining whether the thermostat is operating properly.

In all prior art applications the thermostat has been engaged in either a housing or section of the radiator inflow hose or in the engine block under a metallic pipe making visual access to the thermostat and the engine coolant impossible without disassembly. In all prior art applications the position and operation of the thermostat and the condition of the engine coolant has been hidden behind or in metal housings or rubber hoses or other opaque structures. As a result it has heretofore been impossible to visually determine the condition of the engine coolant and whether the thermostat was operating properly or if it remained in its proper position.

In the past the proper operation of the thermostat could only be confirmed by a mechanic who would operate the engine and feel the radiator hose when the engine reached operating temperature. The problems of determining the proper operation of the thermostat were further aggravated by the temperature and pressures under which internal combustion engines operate together with the chemical composition of the coolant or antifreeze as well as the contaminants that make their way into the cooling system and the radiators over the operating life span of the engine coolant. The possibility of leaks in the cooling system coupled with the introduction of hydrocarbons, acids and other contaminants into the cooling system through bad engine gaskets have heretofore required the use of metal or rubber or housing materials that were opaque making the thermostat not visible.

For most engines the coolant not only contains various types of antifreeze but also is pressurized at a pressure from 6 to 20 psi and operates in ambient temperature ranges from arctic conditions to equatorial conditions which require the thermostat to open once the engine reaches a predetermined temperature which is generally 160, 180 or 212 degrees Fahrenheit. Added to these environmental conditions of course is the chemical composition of the coolant together with the condition of the internal combustion engine and the thermal and mechanical considerations of the system which has resulted in the prior art not utilizing a transparent housing for the engine thermostat.

The temperature, pressure and operating conditions together with the mechanical configurations of engine thermostats has generally required the thermostat to be mounted between the engine block and a curved metal fitting in order to maintain the thermostat in place during operating conditions. The adverse pressures and temperatures encountered in operating conditions has resulted in many in-line applications not being accepted due to the temperature and pressure parameters and the expansion and contraction encountered in typical rubber hoses as a result of the pressure and temperature variations and the possibility of the thermostat becoming dislodged. In other such applications a change in diameter of the in-line thermostat housing has been used to maintain the thermostat housing in a housing made of steel or other appropriate material which housing is then covered with the rubber radiator hose such as in Hovey U.S. Pat. No. 4,583,499 for in-line thermostat applications.

The extremes in temperature and pressure conditions encountered together with the mechanical forces necessary to maintain the thermostat in position has generally required the placement of the thermostat in the engine block and has resulted in transparent plastic being an unacceptable material due to the corrosive nature of the engine coolant coupled with the temperatures, pressures and mechanical considerations. These mechanical considerations not only include thermal expansion and contraction but also mechanical forces necessary to hold the housing in place. These mechanical considerations together with the chemical considerations of the coolant has resulted in plastic and particularly transparent plastic not being considered as being suitable materials for use in combination with engine thermostats.

The invention is the result of an extensive research investigation into transparent thermoplastic materials and in contrast to the prior art employs a thermoplastic transparent plastic for use as a viewable housing to provide visual confirmation as to the proper operation of the engine thermostat. The invention not only provides for visual access to the thermostat where the coolant is clear or lightly colored but also provides visual indication of the proper operation of the thermostat by providing visual access to the disturbed flow of engine coolant where the coolant is heavily colored or opaqued by engine contamination. In addition it has been found that certain transparent visible thermostat housings may be utilized and operate in the mechanical, chemical extreme conditions encountered in internal combustion engines. The transparent thermoplastic materials not only withstand the operative environments but also do not become discolored, distorted or opaqued by the engine coolant to provide visual confirmation of the thermostat in all phases of the engine operation and provides visual confirmation of the status of the engine coolant.

SUMMARY OF THE INVENTION

The disadvantages and limitations of prior art cooling systems and thermostatic housings as well as the difficulty for accessing and replacing thermostats is obviated by the invention which provides a novel, viewable housing made of a transparent thermoplastic material. The transparent thermostat housing can be used for in-line applications as well as in applications where the housing is bolted or otherwise mechanically attached to the engine block. The transparent or viewable thermostat housing may be made in a variety of configurations to suit particular requirements and may include optional covers or sleeves for protecting the transparent housing from dirt, oil, grease and other debris.

The novel transparent thermoplastic housing provides direct visual indication as to the operation of the thermostat as well as an indication as to the condition of the engine coolant. In the preferred embodiment of the invention the thermostat is placed in line so as to reduce the amount of labor required to access and replace the thermostat and/or thermostat housing. The visually clear thermoplastic housing may further be optically enhanced to magnify the thermostat so that its operation becomes more apparent by visual inspection during operation. The transparent housing as heretofore indicated may be placed either in line or in the engine block in accordance with the invention. The transparent housing can be utilized in all liquid cooled engine systems since the transparent thermoplastic housing of the invention is virtually unaffected by the chemical, mechanical and thermal conditions encountered in the operation the internal combustion engines.

The invention was the subject of an extensive research investigation into various types of transparent thermoplastic materials. The transparent thermoplastic materials employed should exhibit thermal stability of 270 degrees Fahrenheit (130 degrees Celsius) or better and have a tensile strength of about 10,000 psi or better and have an optical transparency of 70 percent or better. The materials currently available are polycarbonates (LEXAN) and polyurethanes (ISOPLAST) which may be annealed to increase the thermal stability of the transparent thermoplastic. Other transparent thermoplastic materials have been tested but have not exhibited sufficient stability against various types of coolants, contaminants and engine acids which can discolor and distort other types of plastics that might otherwise be suitable for thermostat housings where an antifreeze and water solution is utilized. Even if a pure water and antifreeze solution is utilized at the outset engine operation introduces various contaminants which degrade and discolor the effectiveness of some thermoplastic materials after prolonged operation.

It has been found in the course of the extensive research investigation that clear polyurethanes such as ISOPLAST 302 as available from Dow Chemical Company and polycarbonates such as LEXAN may be employed to construct transparent thermoplastic thermostat housings. In the best mode of the invention transparent polyurethanes are preferred since such materials exhibit the best resistance to a wide variety of contaminants over long periods of time. In accordance with the preferred embodiment of the invention ISOPLAST 302 as may be obtained form the Dow Chemical Company is better than other thermoplastic materials since it resists thermal and mechanical stresses encountered in normal engine operation parameters while exhibiting resistance to coolants including acid and caustic materials which could be cooling system contaminants over years of use.

In accordance with the preferred embodiment of the invention transparent polyurethane thermoplastic housings are formed in a variety of configurations to assist in the visual confirmation of the proper operation of the thermostat. The clear polyurethane thermoplastic housing is formed in a variety of spherical or cylindrical shapes of varying cross sectional diameters and thicknesses to magnify the visual display of the thermostat and increase turbulence in the flow of fluid in the housing to assist in the visual confirmation of the proper operation of the thermostat where the coolant is highly colored or the coolant is expected to opaque after years of use. The transparent thermostat housing also provides a convenient means for visually checking the condition of the coolant and may be used to monitor the condition of the coolant as well as a means for diagnosing other engine problems such as leaking gaskets.

The transparent housing is preferably covered with an elastomeric or fabric cover to prevent oils, greases and dirt from covering the transparent plastic to reduce the requirement to clean the transparent thermostat housing. The transparent thermostat housing is preferably constructed in two pieces which includes a recess or support for capturing the rim of the thermostat and maintaining the thermostat in place during operation. The two parts may be mechanically threaded together with suitable plastic cements or the two pieces may be sonically welded together to interconnect the two pieces of the novel transparent thermoplastic housing. The mechanical threading of the two parts together can be utilized where disassembly of the housing is desired to replace only the thermostat rather than the entire unit when replacement is desired.

The transparent thermoplastic housing may also include means for accommodating different size radiator hoses so that different sized radiator hoses may be utilized. The housing may also include angles, bends and various geometric configurations as well as including the provision for ports for heating hoses and other elements for imparting further advantages to the vehicle heating system for the comfort of the passengers.

The foregoing advantages as well as the ease of replacement and determination of the proper operation of the thermostat in all operating conditions of the engine are achieved by the utilization of the novel thermoplastic clear thermostat housings of the invention. These advantages are particularly achieved by the utilization of a thermoplastic polyurethane clear housing in accordance with the invention for use with all types of coolants and operating conditions.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

The transparent thermostat housing, whether placed in-line, that is between two sections of a radiator inflow hose or for direct attachment to the engine block provides for a visual confirmation as to the proper operation of the thermostat observable through the transparent thermoplastic housing. In most cases where primarily aqueous solutions containing light colored yellow or green antifreezes are utilized the resulting engine coolant is sufficiently transparent to provide a visual indication of the thermostat contained within the clear thermoplastic housing. However even where heavy colored antifreezes or high concentrations of antifreezes are employed as an engine coolant under severe operating conditions the proper operation of the thermostat can still be observed through the clear thermoplastic housing by providing a visual indication of the flowing motion of the engine coolant particularly where the geometric configuration of the housing imparts turbulence to the flow of the coolant.

The utilization of housings having a non uniform diameter such as spherical or frustro-conical are particularly advantageously utilized for conditions where heavy colored or high concentrations of antifreeze are utilized which opaque the view of the thermostat, so that a stopping and starting of the flowing motion of the coolant is augmented by imparting turbulence to the coolant to make the flow of coolant more observable through the clear thermoplastic housing. In all such cases whether or not the housing includes means for augmenting the turbulence or magnifying the thermostat and constituents inside the housing the clear thermoplastic housing provides a visual check of either the thermostat itself or the flowing motion of the engine coolant no matter how light or dark the engine coolant since the proper operation of the thermostat can be observed by a churning motion of the flowing coolant through the clear thermoplastic housing.

In the preferred application of the invention the transparent thermoplastic housing is mounted between two sections of the radiator hose returning hot engine coolant to the radiator. The in-line thermostat housing whether manufactured for attachment to the engine block or between sections of the radiator hose is heat resistant to about 270 degrees Fahrenheit or more and has a tensile strength of 10,000 psi or more and is manufactured from transparent polycarbonate, polyurethane or other thermoplastic materials with similar or better mechanical and thermal properties.

Figure 1:
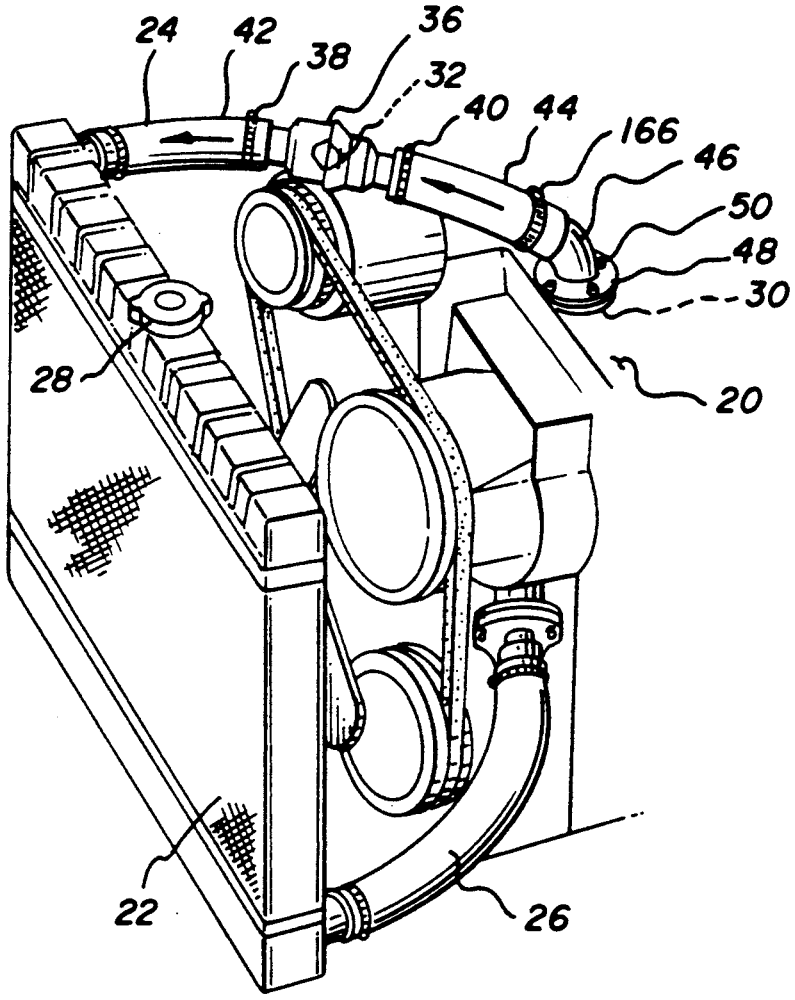
FIG. 1 is a perspective view of a portion of an engine block and cooling system illustrating alternative applications of various embodiments of the novel transparent thermoplastic thermostat housing.

The preferred material from which to form the clear thermoplastic housing is a polyurethane such as ISOPLAST 302, available from Dow Chemical Company since it not only provides the necessary resistance to a variety of radiator coolants but also to acids and caustic solutions which could be encountered under operating conditions. Referring now to FIG. 1 a portion of the engine block 20 is illustrated having a radiator 22 connected to a radiator inflow hose 24 to return hot engine coolant to radiator 22 and a radiator outflow hose 26 for returning cooled engine coolant back to the engine block 20 from the radiator 22. Generally the circuit from the engine block 20 to the radiator 22 is pressurized from about 8 to 14 psi and generally at about 12 psi with the temperatures ranging from between 160 to 190 degrees Fahrenheit. To maintain pressurization a radiator cap 28 is provided to close the system and a thermostat is generally provided in the prior art in recess 30 in engine block 20.

The novel transparent thermoplastic thermostat housing constructed in accordance with the invention may be utilized either in-line with the radiator inflow hose 24 or as a housing for maintaining the thermostat in the recess 30 in engine block 20. In one embodiment of the invention an in-line transparent thermoplastic thermostat housing 36 is clamped by means of clamps 38 and 40 between two sections 42 and 44 of radiator inflow hose 24. In another embodiment of the invention an engine block transparent thermoplastic thermostat housing 46 may be constructed to form a clear engine block housing (FIG. 9) which may be bolted to the engine block by means of a flange 48 and bolts 50 to maintain a thermostat 32 in housing 46 or in recess 30. The configuration of thermostat housing 46 can also be curved to provide a magnification of the thermostat and assist in the visual confirmation of the proper operation of the thermostat as will be discussed hereinafter in greater detail.

In either embodiment the transparent thermoplastic thermostat housing provides visual access to the operation of the thermostat. As will be recognized by those skilled in the art only one thermostat is utilized in a cooling system and therefore either in-line transparent thermoplastic thermostat housing 36 may be utilized in which case the standard gooseneck fitting is utilized but no thermostat is placed underneath the prior art gooseneck fitting in recess 30. Alternatively if engine block transparent thermoplastic thermostat housing 46 (FIG. 9) is utilized then the thermostat 32 is placed in recess 30 and housing 46 is attached to the engine block 20 to maintain the thermostat within recess 30.

Figure 2:
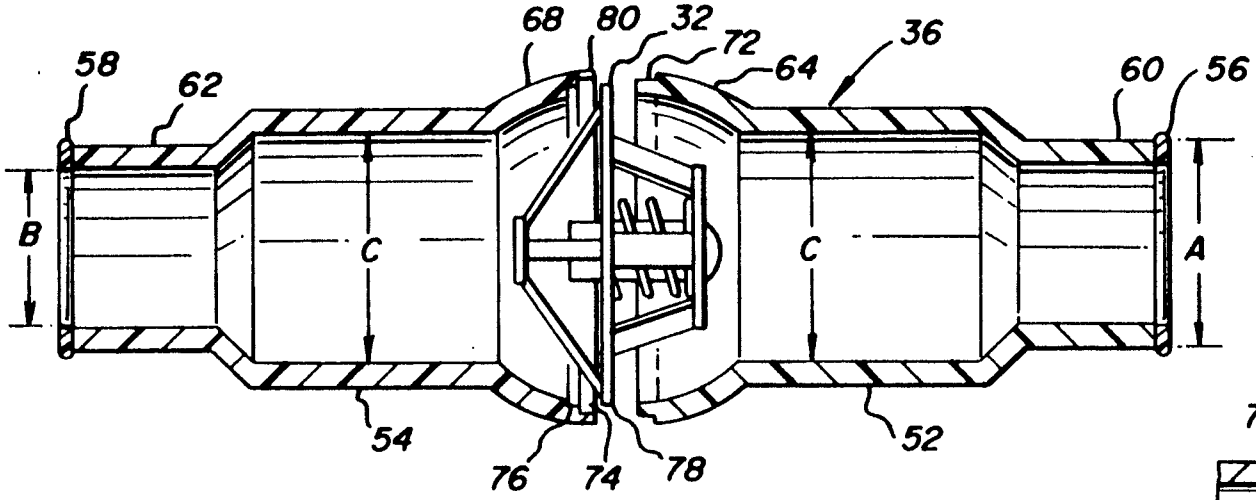
FIG. 2 is an exploded side elevational view of a novel transparent thermostat housing constructed in accordance with the preferred embodiment of the invention.
Figure 3:
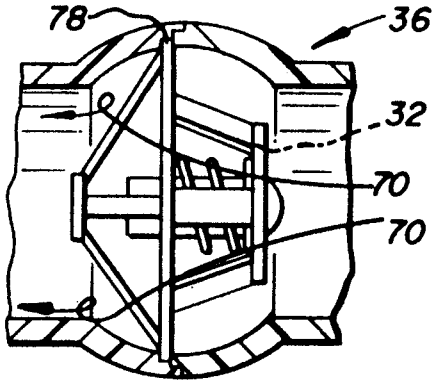
FIG. 3 is a fragmentary side elevational view of FIG. 2 with the two halves assembled.

In the preferred embodiment of the invention an in-line transparent thermoplastic thermostat housing 36 is utilized. The transparent thermoplastic thermostat housing 36 may be in a variety of configurations such as illustrated in FIGS. 2, 3, 4, 5, 6, 7, 10 and 11. The function of the various clear thermoplastic housing is to provide visual access and in some cases such as FIG. 2, 4, 6 and 7 the configuration of the housing may be employed to optically enhance the view of the thermostat by utilizing the curvature of the thermoplastic housing or to provide an enhancement to the visual effects by magnifying the image of the thermostat or providing a constrained path of flow to increase the churning of radiator coolant. In the preferred application an in-line transparent thermoplastic thermostat housing 36 such as illustrated in FIG. 2 is utilized in which the housing 36 is made of two sections 52 and 54.

The sections 52 and 54 may be of the same or of a different configuration and only one of the sections needs to be transparent in order to provide a visual confirmation of the proper operation of the thermostat and status of the engine coolant. In the preferred embodiments of the invention both sections 52 and 54 are clear and include a lip 56 and 58 and a cylindrical section 60 and 62 which cooperate with lip 56 and 58 to engage respectively section 44 and section 42 of radiator inflow hose 24 (FIG. 1). Cylindrical sections 60 and 62 together with lip 56 and 58 provide a circular restraining surface for clamp 40 and 38 respectively to maintain the housing in between section 42 and 44 of radiator inflow hose 24. Both section 52 and 54 include a frustro-spherical section 64 and 68 which terminate in means for interconnecting sections 52 and 54.

The frustro-spherical section 64 and 68 may be optically enhanced to magnify and assist in the visual verification of the operation of the thermostat by magnifying the thermostat where the engine coolant is clear or slightly colored. The frustro-spherical shape of the interior of sections 64 and 68 also assist in the visual confirmation of the proper operation of the thermostat by providing a churning action as indicated by arrow 70 in FIG. 3 when thermostat 32 opens upon the engine attaining this operating temperature.

Sections 52 and 54 further include means at the end of frustro-spherical sections 64 and 68 for joining the two halves together to form a single housing. The means for joining the section may be sonic welded, threaded or other means for attachment of section 52 and 54 to provide a fluid tight seal. The frustro-spherical section 64 terminates in a step down portion 72 which is designed to fit in recess 74 to provide a fluid tight seal by sonic welding. A further recess 76 is provided to capture and engage the annular flange 78 of the thermostat 32. Once the corresponding lip 80 of section 54 is placed over step down portion 72 and the pieces sonic welded together a unitary in-line transparent thermoplastic thermostat housing 36 is provided for installation into the radiator inflow hose 24 as illustrated by housing 36 in FIG. 1.

Figure 5:
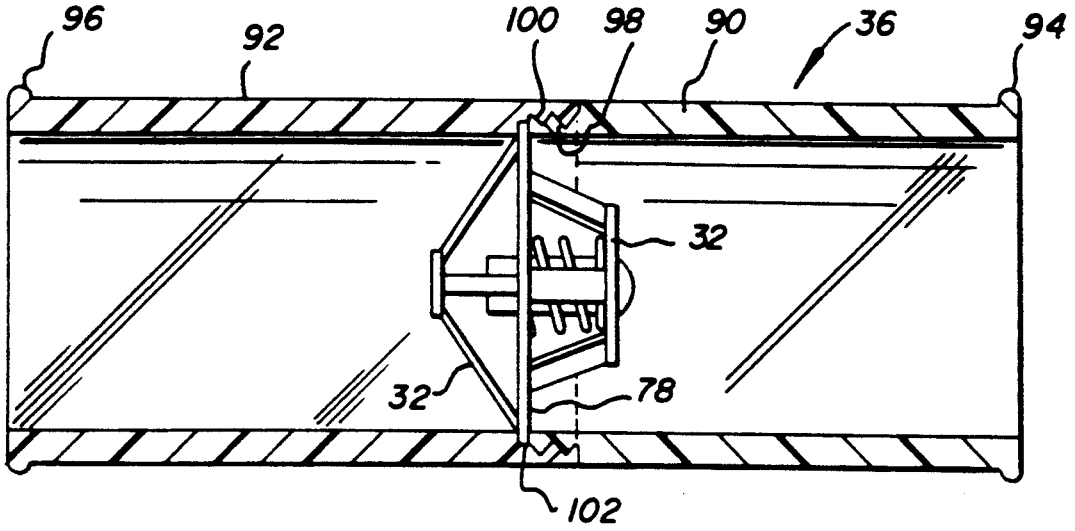
FIG. 5 is a side elevational view of a further embodiment of the transparent thermostat housing illustrating a threaded interconnection between two halves.

Various other types of configurations can be utilized as well as different means for joining together the two halves of the transparent thermostat housing. For example a cylindrical section may be utilized as illustrated in FIG. 5. The in-line transparent thermoplastic thermostat housing 36 in FIG. 5 includes two sections 90 and 92 of transparent thermoplastic material each having a lip 94 and 96 for assisting in the engagement of sections 42 and 44 of radiator inflow hose 24 by means of clamps 38 and 40. The radiator inflow hose covers only about 20 percent of the total area of housing 36 to allow the visual inspection of the interior of the housing and thermostat 32. The two sections 92 and 90 of the housing 36 of FIG. 5 terminate in threads, one portion having male threads 98 such as section 90 and the other section having female threads 100 for connecting sections 90 and 92 of housing 36 and providing a fluid tight closure.

The in-line transparent thermoplastic thermostat housing 36 in FIG. 5 also includes a recess 102 for engaging the annular flange 78 of thermostat 32 to maintain thermostat 32 in place when the two sections are joined together. In applications utilizing a threaded connection a threaded portion of from ¼ an inch or more with threads of a small pitch angle are preferably employed for joining sections 90 and 92 together to provide a fluid tight seal. The advantage of a housing such as illustrated in FIG. 5 is that it can be easily disassembled and the thermostat replaced without discarding the entire housing with the thermostat as a single unit which is required when the two sections are sonic welded together. In addition FIG. 5 provides advantages in that it is less expensive to manufacture but has the disadvantages of not providing a magnification of the thermostat or provide a more dramatic confirmation of the flow of coolant in the thermostat housing. As will be recognized by those skilled in the art threads can be utilized to join thermostat housings of other configurations together such as illustrated in FIGS. 2, 4, 7 and 8.

Figure 6:
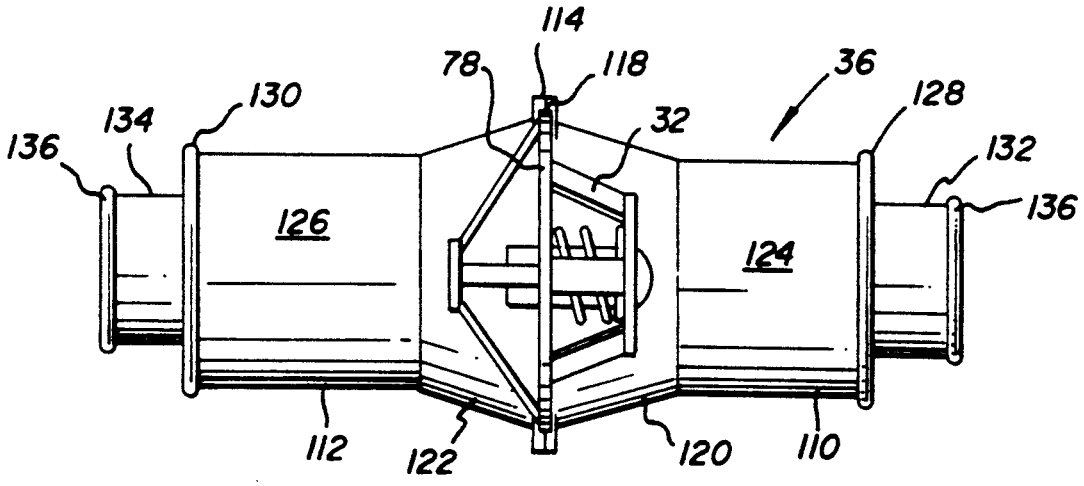
FIG. 6 is a side elevational view of a further embodiment of the transparent thermostat housing having means for accommodating radiator hoses of the same or different sizes.

Referring now to FIG. 6 other configurations and modifications may be made to the invention to provide further advantages. The in-line transparent thermoplastic thermostat housing 36 as illustrated in FIG. 6 like the in-line transparent thermoplastic thermostat housing of FIG. 2 includes two halves 110 and 112 sonically welded together at an overlapping rim 114. The rim 114 includes a recess 118 for capturing the flange 78 of thermostat 32 in the same manner as previously discussed with respect to FIG. 2 and FIG. 5. Both halves 110 and 112 include a tapered area 120 and 122 for assisting in the visual confirmation of the proper operation of thermostat 32. The housing 36 as illustrated in FIG. 6 also includes a cylindrical portion 124 and a cylindrical portion 126 terminating in a lip 128 and 130 respectively. The lip 128 and 130 are part of a unitary construction which steps down to a second cylindrical portion 132 and 134 respectively.

The second cylindrical portion 132 terminates in a second lip 136 and the second cylindrical portion 134 terminates in a second lip 138. The purpose of cylindrical portion 124 and lip 128 and second cylindrical portion 132 and second lip 136 is to provide an adaptor for two different hose sizes for radiator inflow hose 24. For example in FIG. 1 if section 44 (FIG. 1) is a 2 inch diameter hose it can be connected to housing 36 around cylindrical portion 124 using clamp 40. If the hose diameter for section 42 has to be smaller, for example 1¼ inches in diameter, the 1¼ inch diameter hose can be attached to second cylindrical portion 134 via clamp 38. In this manner using one or more cylindrical portions of different diameters two or more different hose diameters can be accommodated while providing the advantages of a transparent thermostat thermoplastic housing for providing visual confirmation of the proper operation of the thermostat.

Figure 7:
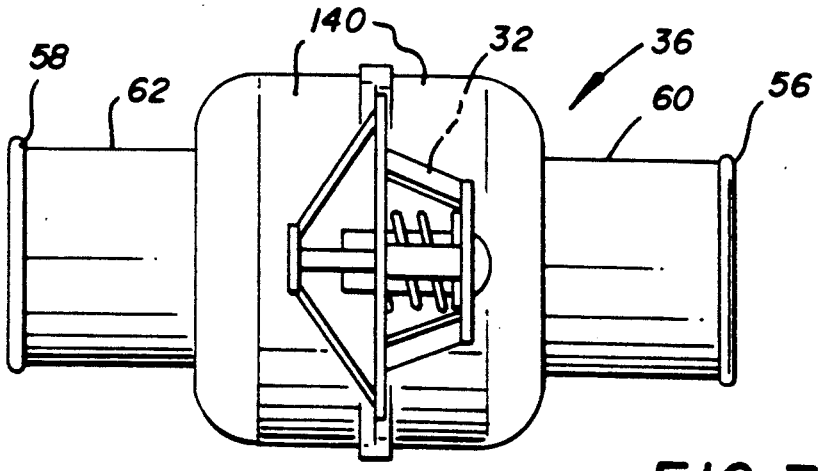
FIG. 7 is a side elevational view of a further embodiment of a transparent radiator housing constructed in accordance with the invention.
Figure 8:
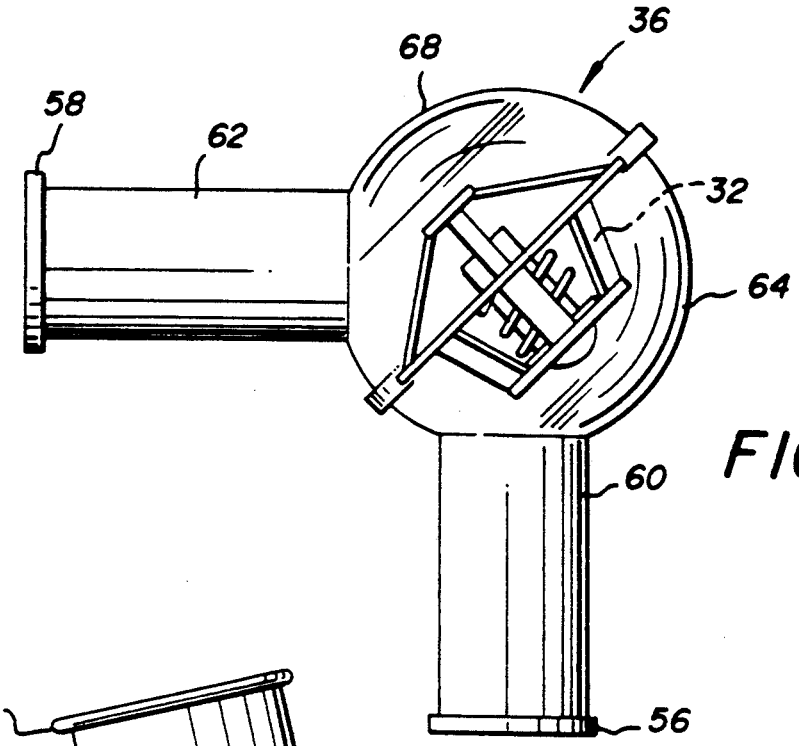
FIG. 8 is a side elevational view of a further embodiment of a transparent radiator housing providing means for optically enhancing the view of the thermostat and providing for a 90 degree turn in the radiator hose.

As indicated in FIG. 7 and FIG. 8 various configurations for the in-line transparent thermoplastic thermostat housing 36 may be utilized including angles for changing the direction of flow between sections 42 and 44 of radiator inflow hose 24 (FIG. 8). In all such applications the body of the transparent thermoplastic thermostat housing includes lips 56 and 58 and hose attachment cylindrical sections 60 and 62 together with a view augmenting section 140 for magnifying or increasing the optical magnification and clarity for viewing the thermostat 32 or the engine coolant flowing in housing 36.

The in-line transparent thermoplastic thermostat housing 36 of FIG. 8 similarly includes a lip 56 and 58 together with a cylindrical section 60 and 62 to assist in attaching the in-line thermostat housing to sections 42 and 44 of radiator inflow hose 24. The frustro-spherical sections 64 and 68 of FIG. 8 like the frustro-spherical sections 64 and 68 of FIG. 2 similarly assist in providing visual magnification of thermostat 32 where clear or substantially clear engine coolants are utilized or increases the turbulence imparted to the flow of coolant to assist in visual confirmation of the flow of coolant where the coolant is heavily colored or opaque.

Figure 4:
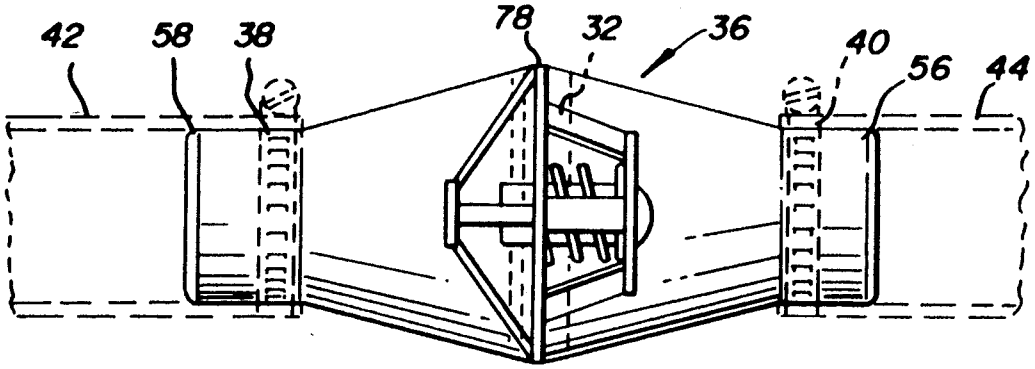
FIG. 4 is a side elevational view of an alternative embodiment of the novel transparent thermostat housing constructed in accordance with the invention.
Figure 10:
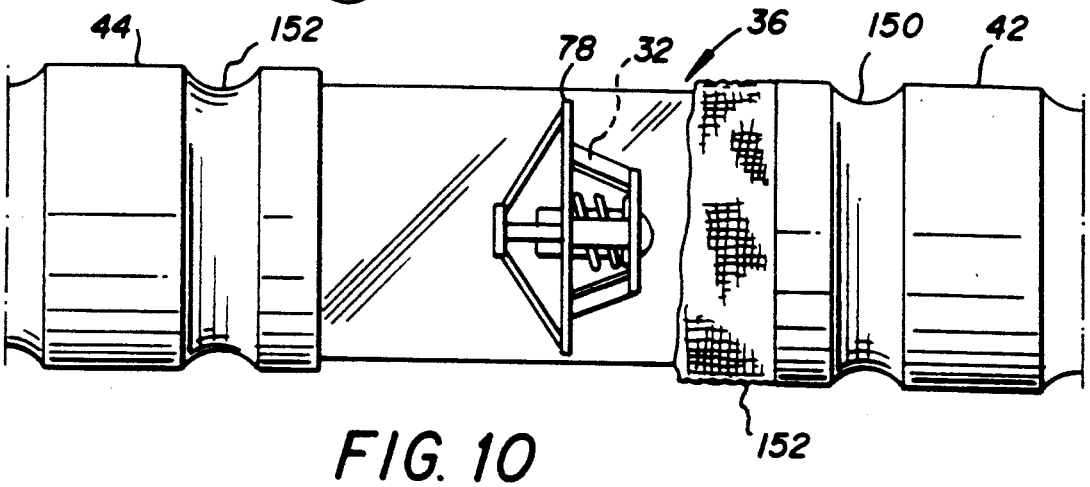
FIG. 10 is a side elevational view of a further embodiment of a transparent thermostat housing constructed in accordance with the invention.

Referring now to FIGS. 4 and 10 a further modification of the invention is illustrated wherein various configurations for the housing are utilized to provide a transparent thermoplastic thermostat housing 36 in which the thermostat 32 is molded into the thermoplastic material to provide a solid unitary construction. In FIG. 4 the solid unitary transparent thermoplastic thermostat housing 36 is of a compound frustro-conical configuration in which the flange 78 of thermostat 32 is molded into the thermoplastic composition to provide a unitary construction. The transparent thermoplastic thermostat housing 36 includes lips 56 and 58 to assist in the attachment and maintaining sections 44 and 42 of radiator inflow hose 24 in place by means of clamps 38 and 40 for placement in-line as illustrated in FIG. 1.

The in-line transparent thermoplastic thermostat housing 36 in FIG. 10 like FIG. 4 is of a unitary construction in which thermostat 32 is molded into a transparent thermoplastic material by molding flange 7 of thermostat 32 into the wall of the hollow in-line transparent thermoplastic thermostat housing 36. Radiator hose sections 42 and 44 are connected to the housing using indentations 150 and 152 for accommodating clamps 40 and 38 respectively. In-line transparent thermoplastic thermostat housing 36 in FIG. 10 includes a cover 152 made of fabric, canvas or other elastomeric material for covering the outside surface of housing 36 to prevent dust, dirt, grease or other debris from dirtying or otherwise decreasing the clarity of the transparent thermoplastic housing.

Figure 9:
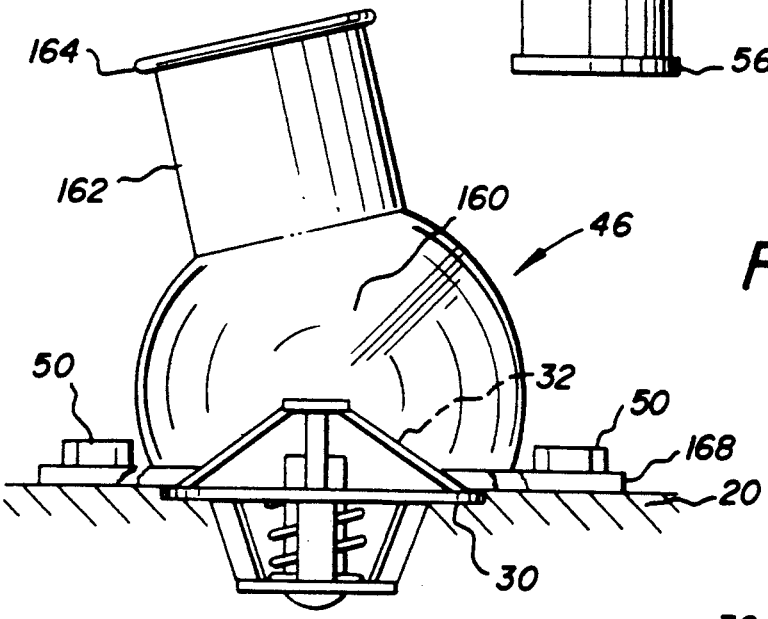
FIG. 9 is a side elevational view of a further embodiment of a transparent thermostat housing providing optical enhancement for viewing the operation of the thermostat and providing for direct attachment to the engine block.

Referring now to FIG. 9 an alternative embodiment of the invention is illustrated in which an engine block transparent thermoplastic thermostat housing 46 is provided for direct attachment to engine block 20 to maintain thermostat 32 in recess 30 in the engine block. The engine block transparent thermoplastic thermostat housing 46 allows the thermostat 32 to be disposed in the engine block as is traditionally encountered in liquid cooled engines. The difference between the invention and the prior art is the utilization of a clear thermoplastic housing to provide visual access and confirmation of the operation of the thermostat 32 as well as the condition of the engine coolant for visually monitoring its condition as well as its proper flow.

The engine block transparent thermoplastic thermostat housing 46 of FIG. 9 includes a spherical section 160 to magnify and increase the turbulence of engine coolant from thermostat 32 to provide a visual indication of the proper operation of the thermostat 32 whether a lightly colored or transparent engine coolant is utilized or whether an opaque or heavily colored engine coolant is utilized. The spherical section 160 terminates in a cylindrical portion 162 which terminates in a lip 164. Lip 164 together with the cylindrical portion 162 provides a point of attachment for the radiator inflow hose 24 by means of a suitable clamp 166 (FIG. 1).

The transparent thermoplastic thermostat housing 46 is attached to the engine block 20 by means of bolts 50 which press a flange 168 up against the engine block 20 to provide a fluid tight fit. The flange 168 which is preferably made of metal and forms a ring around the housing 46 to press thermostat 32 in recess 30 to maintain the thermostat in the engine block 20. As heretofore discussed either an engine block transparent thermoplastic thermostat housing 46 is utilized or the in-line transparent thermoplastic thermostat housing 36 is utilized. In most applications two thermostats are neither necessary nor desirable.

Figure 11:
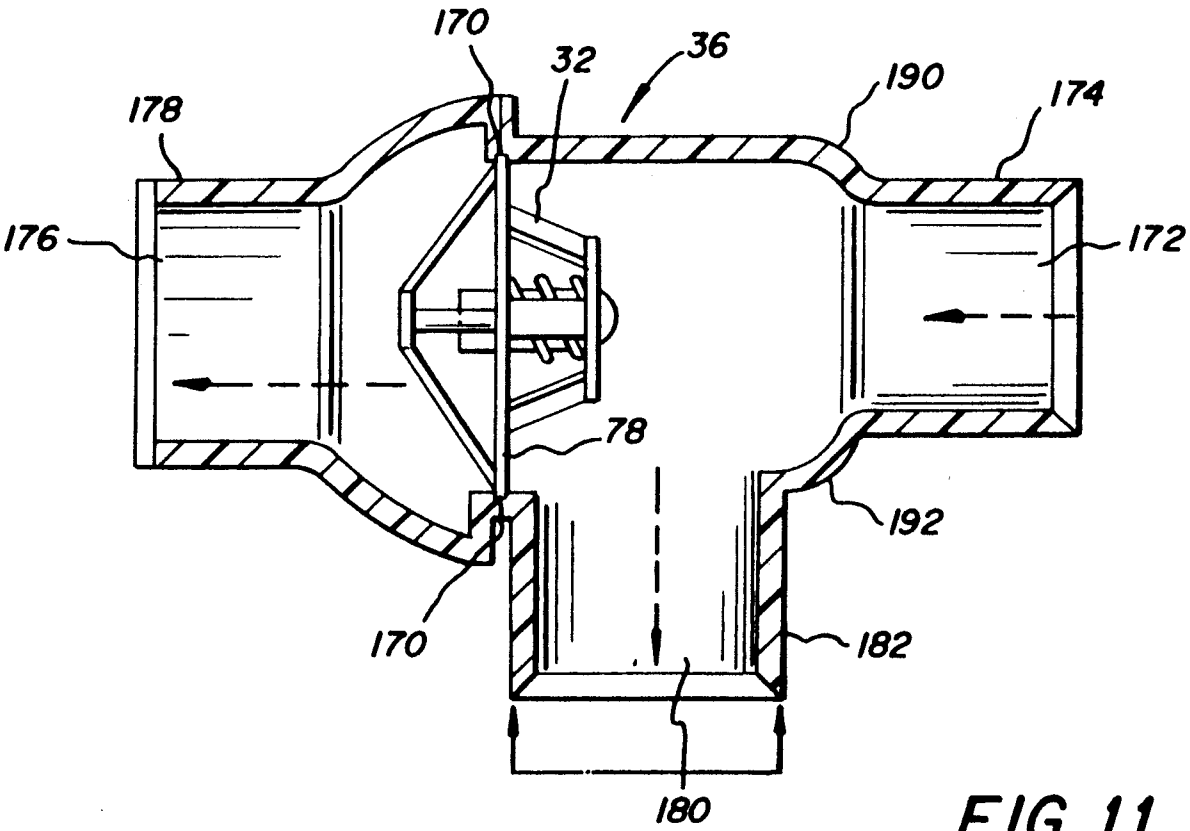
FIG. 11 is a cross sectional view of a further embodiment of the novel transparent thermostat housing of the invention.

Referring now to FIG. 11 a further modification of the novel in-line transparent thermoplastic thermostat housing 36 is illustrated in which thermostat 32 is maintained in position in a recess 170 which engages flange 78 of thermostat 32. The novel thermoplastic thermostat housing as illustrated in FIG. 11 provides additional advantages since housing 36 is maintained between section 42 and 44 (FIG. 1) of radiator inflow hose 24 in which section 44 is attached to port 172 at end 174 and section 42 is attached to port 176 at end 178. Housing 36 of FIG. 11 allows the attachment of a heater hose to port 180 in end 182. The utilization of ports 172 and 182 on the engine side of the thermostat 32 allows engine coolant to travel directly from the engine to the automobile heater without the requirement of thermostat 32 first opening. This arrangement not only provides for better heating output of the automobile heater but also provides easier access and maintenance of the heater circulation line while providing visual confirmation of the circulation to the heater system before the thermostat opens. The curved surfaces 190 and 192 are for providing magnification or turbulence enhancement to the engine coolant to assist in the visual detection of the circulation of engine coolant.

As heretofore discussed the novel transparent thermoplastic housings may be constructed of various transparent plastics possessing sufficient thermal, mechanical and chemical stability for use in the engine cooling systems. The transparent thermoplastic housing of the invention is preferably formed from polyurethane or polycarbonate transparent thermoplastics or other thermoplastic materials that have the same or better resistance properties to thermal, mechanical and chemical conditions encountered in engine cooling systems.

In the preferred embodiment the housing is from 0.1 inch to about 0.4 inch thick and preferably 0.125 inch. The typical dimension of transparent thermoplastic thermostat housings as for example in FIG. 2 as indicated by arrow A is about 1¼ inches for receiving a standard radiator hose and the internal diameter of about 15/16 of an inch as indicated by arrow B in FIG. 2 and the expanded area as represented by arrow C is about 1 5/16 of an inch and a diameter for receiving thermostat flange 78 is about 1 14/16 of an inch. These dimensions however may be changed or modified to suit particular applications of the novel transparent thermoplastic thermostat housing.

Various clear or transparent thermoplastic housing materials have been tested in accordance with the present invention to determine their effectiveness in various engine coolants and probable contaminants. The most effective transparent thermoplastic housing tested is a transparent or clear polyurethane or polycarbonate thermoplastic. Other thermoplastic materials tested might be used but only here an uncontaminated specific type of coolant is utilized and as a result are not preferred due to their physical and chemical limitations. The various thermoplastic compounds tested and the test results are listed in the following illustrative examples which are set forth for the purposes of illustration and not as a limitation of the invention.

EXAMPLE 1

A transparent piece of acrylic plastic as may be obtained from C. E. I. Plastics of Odessa, Texas was tested in various types of solutions representing engine coolants and possible contaminants. A flat piece of the acrylic plastic of about 5 inches long, 2 inches wide and ¼ inch thick was placed in the following solutions under the conditions specified with the following results:

A. Antifreeze and water solution 66 percent antifreeze and 33 percent water by mixing two quarts Xerex antifreeze with one quart of water. The acrylic plastic sample was placed in the solution for 102 hours and the solution was periodically heated to 212 degrees Fahrenheit. The sample was inspected visually and no cracks or discoloration were observed.

B. A second solution of brine water and antifreeze was prepared by adding about ½ pound of salt to ½ gallon of water and ¼ gallon of antifreeze. An acrylic plastic sample of the dimensions heretofore described was placed in the solution and the solution was heated periodically to 212 degrees Fahrenheit for 104 hours. The sample was removed and exhibited slight discoloration upon visual inspection.

C. A third solution made up of brine water was prepared by adding about ½ pound of salt to ½ gallon of water to which 5 ounces of muriatic acid 20 percent was added. The solution was heated periodically with an acrylic plastic sample having the dimensions as previously described. The sample was discolored and yellowed.

D. A fourth solution made up by adding 5 ounces of muriatic acid 20 percent to 2 ounces of nitric acid 42 percent and an antifreeze solution made up of 10 ounces of antifreeze and 7½ ounces of water. A sample of acrylic plastic was tested for 100 hours in the solution which was periodically heated to 212 degrees Fahrenheit. The plastic sample was distorted and discolored upon visual inspection.

E. A fifth solution made up by adding ½ pound of salt to ½ gallon water and ¼ gallon antifreeze, 5 ounces muriatic acid 20 percent and 2 ounces of nitric acid 42 percent and 5 ounces of caustic soda and 2 ounces of oil. An acrylic plastic sample having the dimensions as previously described was placed in the solution for 200 hours and the solution was periodically heated to 212 degrees Fahrenheit. The sample was removed and exhibited complete distortion, discoloration and yellowing.

EXAMPLE 2

A transparent piece of thermoplastic polycarbonate (LEXAN) as may be obtained from C. E. I. Plastics of Odessa, Texas was tested in the fifth solution of Example 1 which included salt, antifreeze, muriatic acid, nitric acid, caustic soda and oil. The fifth solution was selected for testing this as well as the other plastic samples since it represented the most severe test conditions of the solutions tested. The thermoplastic polycarbonate piece tested was about 5 inches long, 2 inches wide and about ¼ inch thick. The sample was tested for a period of about 505 hours and exhibited slight discoloration.

EXAMPLE 3

A transparent piece of plexiglass as may be obtained from C. E. I. Plastics of Odessa, Texas was tested in the fifth solution of Example 1. The transparent piece of plexiglass was about 5 inches long, 2 inches wide and about ¼ inches thick. The sample was tested for a period of about 504 hours after which the sample revealed visible stress cracks, distortion and discoloration.

EXAMPLE 4

A transparent piece of polymethyl(methan) cryolate of about 5 inches long, 2 inches wide and about ¼ inches thick as may be obtained from C. E. I. Plastics of Odessa, Texas was tested in the fifth solution of Example 1. The sample was tested for a period of about 504 hours. The sample revealed distortion and a clouding and yellowing.

EXAMPLE 5

A transparent piece of thermoplastic polyurethane as may be obtained from Dow Chemical company under the tradename ISOPLAST 302 was tested for a period of 21 hours in the fifth solution of Example 1. The solution was periodically heated to a temperature of 212 degrees Fahrenheit. The transparent piece of thermoplastic polyurethane did not crack, distort or discolor. The transparent thermoplastic polyurethane retained its clarity and stability.

EXAMPLE 6

A transparent piece of thermoplastic polyurethane of the same type as described in Example 5 was tested in a 50 percent antifreeze 50 percent water containing about ½ pound of salt. The solution was periodically heated to a temperature of 212 degrees Fahrenheit for a period of 216 hours. The transparent thermoplastic polyurethane sample did not discolor, distort or crack. The sample maintained its clarity and stability.

EXAMPLE 7

A hollow tube of (LEXAN) polycarbonate as obtained from C. E. I. Plastics of Odessa, Texas was used to form a transparent thermoplastic thermostat housing. The tube of about 2 inches in diameter of about 5 inches long having a wall thickness of about ⅛ was sawed in half and ends threaded to form a housing and a recess was formed in the wall to hold the outside rims of the thermostat. The pieces were assembled together with the thermostat and placed in a 1977 Ford Courier 1800 cc.

1. Thermostat operating temperatures of about 195 degrees Fahrenheit.
2. Capacity of engine coolant was approximately 8 quarts or 2 gallons.
3. The water pump circulated cooling fluid at approximately 7500 gallons an hour;
   A. 125 gallons a minute;
   B. 2 gallons a second;
   C. By the time the thermostat opens and closes the coolant will have circulated 4 complete cycles.
4. At a radiator pressure of about 11–12 psi. The radiator contained about 2 gallons of engine coolant made up of about ¾ gallons of water and 1¼ gallons of antifreeze which had been in the system for about 3 months.

NOTES AND RESULTS

Vehicle was run for 30 minutes and the temperature rose to only 145 degrees Fahrenheit, with an outside temperature of about 56 degrees Fahrenheit.

The vehicle was driven for 10 miles, approximately 30 minutes to warm up the engine, temperature rose only to 180 degrees Fahrenheit.

The vehicle was allowed to idle another 30 minutes before the temperature finally rose to 190 degrees Fahrenheit. At 190 degrees Fahrenheit the thermostat opened for approximately seconds and the temperature cooled down to 178 degrees Fahrenheit. The operation of the thermostat as well as the churning action of the coolant when the thermostat opened was observed through the thermoplastic housing. Then with the engine still idling, the temperature would rise to 190 degrees Fahrenheit, the thermostat would again open for approximately 4 seconds and would cool down to 178–175 degrees Fahrenheit, and would complete cycle again which could be observed directly through the transparent thermostat housing. Cycling time varied from about 6 to 9 minutes apart.

EXAMPLE 8

The thermostat housing of Example 7 was further tested with an outside air temperature of approximately 20 degrees Fahrenheit. The vehicle temperature gauge did not rise above 175 degrees Fahrenheit during a 20 minute drive so the thermostat may not have opened. A leak developed at the place where the hose was clamped. After tightening the hose clamp it resulted in stress cracks in the thermostat housing. The cracks came from the increased tightening and developed at the ends which were held in the jaws of the machine lathe. Polishing the inside and outside of the housing as well as protecting and/or reinforcing the tube as it is worked on a lathe would remove the predisposition to cracking as well as molding the entire piece with or without threads.

The foregoing examples illustrate the advantages of transparent thermoplastic housings for application to fluid cooled engines to provide visual confirmation as to the operation of the vehicle thermostat. The foregoing examples further demonstrate that transparent thermoplastic housings exhibiting the properties of polyurethanes and polycarbonate plastics can be utilized to form transparent thermostat housings.

As will be recognized by those skilled in the art the invention has a wide range of applicability to various types of engine cooling systems employing a thermostat. The invention may be implemented by constructing transparent thermoplastic housings that may be placed either in between sections of a radiator inflow hose or bolted to the engine housing. The novel transparent thermoplastic thermostat housing provides direct visual confirmation of the proper operation of the thermostat by either providing visual contact with the thermostat itself where the engine coolant is clear or lightly colored or in cases where the engine coolant is opaque or heavily covered by confirming the proper operation of the thermostat by providing an indication of turbulence of the opaque engine coolant through the clear thermoplastic housing.

The invention provides a number of variations to accommodate different hose sizes as well as providing for different arrangements for the attachment of heater hoses and other hoses associated with the automobile heating and cooling systems. As such the invention may be implemented and modified in a variety of ways to suit particular requirements for providing visual reference to the operation of the thermostat. It is further to be understood modifications in the type of plastic and the configuration of the housing may be made by those skilled in the art. All such modifications of the composition of transparent thermoplastic housings as well as mechanical modifications to the housing to provide visual access and confirmation of the proper operation of the thermostat may be made within the scope and spirit of the invention as defined in the following claims.

What is claimed is:

1. A transparent thermostat housing comprising:
   (a) a substantially hollow transparent thermoplastic housing having a first cylindrical open end and a second cylindrical open end;
   (b) a thermostat disposed intermediate said first cylindrical open end and said second cylindrical open end of said substantially hollow transparent thermoplastic housing; and
   (c) a transparent viewing area disposed intermediate said first cylindrical open end and said second cylindrical open end for providing visual access to said thermostat and fluid flowing through said transparent thermoplastic housing.

2. The transparent thermostat housing of claim 1 further comprising a third cylindrical open end communicating with said first cylindrical open end and providing access for a heater hose.

3. The transparent thermostat housing of claim 2 further comprising a cover for covering said transparent viewing area.

4. The transparent thermostat housing of claim 2 wherein said substantially hollow transparent thermoplastic housing is constructed of polyurethane.

5. The transparent thermostat housing of claim 1 wherein said viewing area is of a frustro spherical configuration.

6. The transparent thermostat housing of claim 1 wherein said first cylindrical open end and said second cylindrical open end are not in axial alignment.

7. The transparent thermostat housing of claim 6 wherein said first open end terminates in a flange for mounting to an engine block.

8. A transparent thermoplastic thermostat housing comprising:

(a) a substantially hollow transparent body having a first open end and a second open end and a passage therebetween;

(b) a thermostat having an annular flange;

(c) means in said substantially hollow transparent body for engaging said annular flange of said thermostat and maintaining said thermostat in said passage; and (d) a transparent viewing area disposed intermediate said first open end and said second open end for providing visual access to said thermostat.

9. The transparent thermoplastic thermostat housing of claim 8 wherein said means in said substantially transparent body for engaging said annular flange of said thermostat is disposed at said first open end.

10. The transparent thermoplastic thermostat housing of claim 9 further comprising a flange disposed at said first end for mounting said substantially hollow transparent body to an engine block.

11. The transparent thermoplastic thermostat housing of claim 10 wherein transparent viewing area is of a frustro spherical configuration.

12. The transparent thermoplastic thermostat housing of claim 8 wherein said substantially hollow transparent body is made up of two halves and one of said halves includes said means for engaging said annular flange of said thermostat.

13. The transparent thermoplastic thermostat housing of claim 12 wherein said two halves are sonically welded together.

14. The transparent thermoplastic thermostat housing of claim 12 wherein said first open end and said second open end are not in axial alignment.

15. A liquid coolant and thermostat viewable housing comprising:

(a) a substantially hollow transparent housing having a first open cylindrical open end terminating in a lip and a second open end terminating in a lip;

(b) a thermostat having an annular flange disposed intermediate said first cylindrical open end and said second open end;

(c) a recess in the wall of said substantially hollow transparent housing for engaging said annular flange of said thermostat and maintaining said thermostat in place in said substantially hollow transparent housing;

(d) a transparent viewing area disposed intermediate said first cylindrical open end and said second cylindrical open end for providing visual access to said thermostat and engine coolant flowing through said substantially hollow transparent housing.

16. The liquid coolant and thermostat viewable housing of claim 15 wherein said substantially hollow transparent housing is constructed of polyurethane.

17. The liquid coolant and thermostat viewable housing of claim 16 wherein said transparent viewing area includes means for magnifying the image of said thermostat.

18. The liquid coolant and thermostat viewable housing of claim 17 wherein said means for magnifying the image of said thermostat is achieved by employing a frustro spherical shape for said transparent viewing area.

19. The liquid coolant and thermostat viewable housing of claim 18 further comprising a third cylindrical open end terminating in a lip for accommodating a heater hose.

20. The liquid coolant and thermostat viewable housing of claim 18 further comprising a cover for protecting said transparent viewing area.

* * * * *